US006219945B1

(12) United States Patent
Heishi et al.

(10) Patent No.: US 6,219,945 B1
(45) Date of Patent: Apr. 24, 2001

(54) EXCAVATING METHOD

(75) Inventors: Mituo Heishi; Motohiko Mizutani, both of Akashi (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/054,458

(22) Filed: Apr. 3, 1998

(30) Foreign Application Priority Data

Apr. 8, 1997 (JP) ..... 9-089255

(51) Int. Cl.[7] ..... E02F 1/00; E02F 3/08; E21C 25/00

(52) U.S. Cl. ..... 37/358; 37/352; 37/462; 37/195; 299/73; 299/76

(58) Field of Search ..... 37/93, 189, 195, 37/352, 462, 465, 358; 299/73, 76

(56) References Cited

U.S. PATENT DOCUMENTS

| | | | | |
|---|---|---|---|---|
| 1,767,417 | * | 6/1930 | Weber | 37/352 |
| 3,603,010 | * | 9/1971 | Polinek | 37/83 |
| 3,908,292 | * | 9/1975 | Harris | 37/142.5 |
| 3,985,305 | * | 10/1976 | Williamson et al. | 241/101.7 |
| 4,641,889 | * | 2/1987 | Brandl | 299/75 |
| 4,750,280 | * | 6/1988 | Dalaine | 37/86 |
| 4,890,399 | * | 1/1990 | Stiff et al. | 37/86 |
| 4,922,763 | * | 5/1990 | Ashworth | 73/864.41 |
| 5,112,161 | * | 5/1992 | Trevisani | 405/267 |
| 5,471,771 | * | 12/1995 | Gilbert | 37/352 |
| 5,478,139 | * | 12/1995 | Scott | 299/76 |
| 5,561,923 | * | 10/1996 | Kitanaka | 37/352 |

FOREIGN PATENT DOCUMENTS

| | | |
|---|---|---|
| 163 387 | 10/1970 | (DE) . |
| 0 249 231 A1 | 12/1987 | (EP) . |
| 0 659 943 A1 | 6/1995 | (EP) . |
| 6-336749 * | 6/1994 | (JP) . |

OTHER PUBLICATIONS

Patents Abstracts of Japan, vol. 1995, No. 03, Apr. 28, 1995 & JP 06 336749 A (Doboku Kenkyu Center; Others: 08), Dec. 6, 1994.

Patent Abstracts of Japan, vol. 011, No. 393 (M–654), Dec. 23, 1987 & JP 62 160330 A (Fusao.

* cited by examiner

*Primary Examiner*—Eileen D. Lillis
*Assistant Examiner*—Gary S. Hartmann
(74) *Attorney, Agent, or Firm*—Oblon, Spivak, McClelland, Maier & Neustadt, P.C.

(57) ABSTRACT

A method of excavating an underground continuous ditch by rotating a chain type cutter 4 while pressing the cutter horizontally against the ground A, with the cutter positioned underground. According to this method, when a lower ground portion is left unexcavated due to a deficiency in traversing force at the lower portion of the cutter particularly during excavation at a large depth, the rotating direction of the cutter 4 is changed from a rake-up direction in normal excavation to a rake-down direction and excavation is performed while the cutter is moved vertically, to excavate the lower ground portion (A1) left unexcavated.

15 Claims, 5 Drawing Sheets

EXCAVATING METHOD

BACKGROUND OF THE INVENTION

1. Field of the Invention

The present invention relates to an excavating method for excavating an underground continuous ditch to construct an underground continuous wall to be used, for example, for water sealing or for foundation.

2. Description of the Prior Art

Heretofore, as an apparatus for excavating an underground continuous ditch, there has been known such an apparatus as shown in FIG. 6, in which a chain type cutter 4 is attached vertically to a traveling carrier car 1 through a main frame 2 and a leader 3, and with the cutter 4 positioned underground, the cutter is rotated while being allowed to move horizontally (traversing), to excavate a ditch G of a constant width continuously (see, for example, Japanese Patent Laid Open Nos. 280043/93,280044/93 and 173835/95).

The chain type cutter 4 comprises an endless chain 8 and a large number of excavating edges 9 formed on the outer periphery of the chain 8 to excavate the ditch G. The endless chain 8 is stretched between a driving wheel (sprocket) 6 disposed at the upper end of a cutter post 5 which is a vertically long, box-shaped frame and a floating wheel (pulley) 7 disposed at the lower end of the cutter post.

The cutter 4 is supported vertically movably with respect to the leader 3. It is moved vertically to adjust the depth by means of a lift cylinder (a hydraulic cylinder) 10 disposed between the leader 3 and the cutter 4 or by such a lift means as a winch (not shown).

The cutter 4 is also supported so as to be movable (traversing) in the horizontal transverse direction together with the leader 3 with respect to the main frame 2. The cutter 4 is pressed against a ground A (the thick arrow in FIG. 6 represents this pressing force) by means of upper and lower traversing cylinders (hydraulic cylinders) 11, 12 disposed between the main frame 2 and the leader 3.

The traversing force of the cutter 4 is created and imparted to the cutter mainly by the lower traversing cylinder 12. The upper traversing cylinder 11 functions to bear a pressing reaction force.

When the traversing cylinders 11 and 12 assume the state of maximum extension, both cylinders are contracted and at the same time the carrier car 1 advances in the excavating direction. By repeating this operation the ditch G is excavated continuously.

According to such a conventional method for excavating an underground continuous ditch, there arises the following problem because there is performed only the traversing excavation in which the ground A is excavated in reliance on the traversing force imparted to the cutter 4 by the traversing cylinders 11 and 12.

Generally, as the depth increases, the ground A tends to become harder and the frictional force between the cutter 4 and the wall of the excavated ditch G tends to increase.

On the other hand, with an increase of the depth, the traversing force (pressing force) capable of being exerted on the ground A by the cutter 4 becomes smaller, and when the depth exceeds a certain limit, the traversing force required for excavation is no longer imparted to the lower portion of the cutter.

Consequently, the movement of the lower portion of the cutter becomes slower than the upper portion thereof, so that the cutter as a whole is inclined or deflected forward. In this state, the lower portion of the ground A is left unexcavated, which eventually becomes a portion incapable of being excavated.

Thus, according to the conventional excavating method, an excavatable depth limit depth in excavation) is small.

SUMMARY OF THE INVENTION

According to the present invention, in view of the above-mentioned point, there is provided a method for excavating an underground continuous ditch which can make up for the deficiency in traversing excavation and thereby increase the limit depth in excavation.

To be more specific, according to the present invention, in an underground continuous ditch excavating method involving, with a chain type cutter positioned underground, rotating the cutter while pressing the cutter horizontally against the ground, the cutter comprising a cutter post and an endless chain having excavating edges and stretched vertically on the cutter post, there is performed a vertical excavation in which the ground is excavated while the chain type cutter is moved vertically.

According to this method, when it is likely that a portion of the ground will be left unexcavated at the lower portion of the cutter due to insufficient traversing force, or when there actually occurs an unexcavated portion due to tilting or deflection of the cutter, the cutter is raised to decrease the stress acting on the lower portion of the cutter, and thereafter the said ground portion is excavated while the cutter is moved downward, whereby the ground portion left unexcavated can be excavated.

Further, according to the present invention, in an underground continuous ditch excavating method involving, with a chain type cutter positioned underground, rotating the cutter while pressing the cutter horizontally against the ground, the cutter comprising a cutter post and an endless chain having excavating edges and stretched vertically on the cutter post, there is performed a reverse excavation at an appropriate timing in which the rotating direction of the chain type cutter is reversed to reverse the operating direction of the excavating edges against the ground.

According to this method, since the rotating direction of the cutter is reversed, the bite of the excavating edges into the ground A is improved and it is possible to enhance the excavation efficiency to a higher extent than before the reversal of the rotating direction.

Further, according to the present invention, in an underground continuous ditch excavating method involving, with a chain type cutter positioned underground, rotating the cutter while pressing the cutter horizontally against the ground, the cutter comprising a cutter post and an endless chain having excavating edges and stretched vertically on the cutter post, there are simultaneously performed at an appropriate timing both a reverse excavation in which the rotating direction of the chain type cutter is reversed to reverse the operating direction of the excavating edges against the ground and a vertical excavation in which the ground is excavated while the cutter is moved vertically.

According to this method as a combination of both vertical excavating method and reverse excavating method, the excavation efficiency is improved to a remarkable extent by virtue of a synergistic effect of the combination in comparison with only the vertical excavation or only the reverse excavation, and the ground portion left unexcavated can surely be excavated.

Further, according to the present invention, in any of the above methods, during normal excavation, the chain type cutter is rotated in a rake-up direction in which the excavating edges of the cutter come into upward contact with the ground, while during reverse excavation, the cutter is rotated in a rake-down direction in which the excavating edges come into downward contact with the ground.

Particularly, by changing from the rake-up rotation to the rake-down rotation during normal excavation, the bite of the excavating edges into a ground portion A1 left unexcavated at the lower portion of the cutter due to tilting or deflection of the cutter is improved and it becomes easier to excavate the unexcavated ground portion A1.

Further, according to the present invention, in any of the above methods, one or both of the vertical excavation and the reverse excavation are performed when the chain type cutter is tilted or deflected forward in the excavating direction.

Further, according to the present invention, in any of the above methods, one or both of the vertical excavation and the reverse excavation are performed while applying a depressing force separate from the own weight of the chain type cutter to the cutter.

According to this method, when there is adopted a construction method in which a liquid solidifyig material such as cement milk is poured into a ditch while excavation is allowed to proceed, it is possible to impart to the cutter a depressing force sufficient to overcome the buoyancy based on the solidifyig material during vertical excavation or reverse excavation and thereby effect the excavation positively.

Thus, by adopting the above excavating methods selectively as necessary, it becomes possible to excavate even a ground portion of a depth for which excavation cannot be done by the normal traversing excavation method alone.

DETAILED DESCRIPTION OF PREFERRED EMBODIMENTS

Embodiments of the present invention will be described hereinunder with reference to FIGS. 1 to 5.

Figure 1:
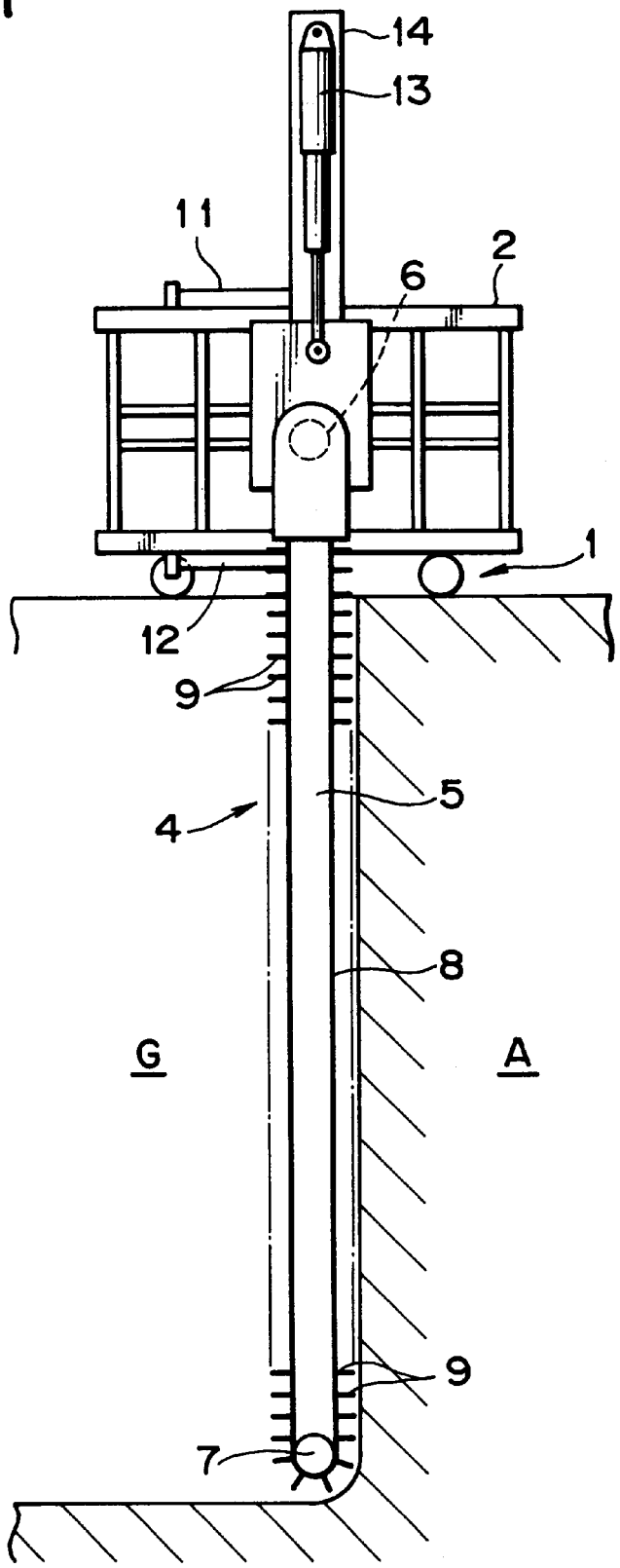
FIG. 1 is a front view showing schematically an entire construction of an excavating apparatus used in a ditch excavating method according to the first embodiment of the present invention.
Figure 2A:
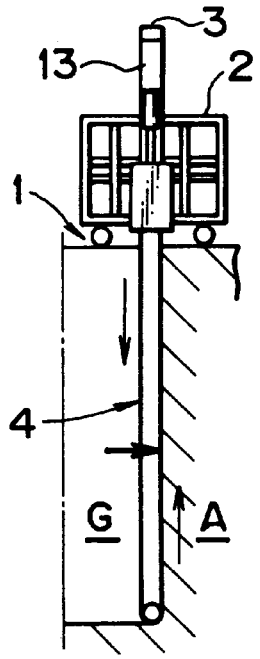
FIGS. 2(*a*) to 2(*f*) are schematic front views of the excavating apparatus, of which (a) shows a state of normal excavation, (b) shows a deflected state of a cutter, (c) shows a state in which a traveling carrier car has been advanced with the cutter deflected and with traversing cylinders contracted, (d) shows a state in which the cutter has been raised and a vertical excavation started, (e) shows a state in which, after the rise of cutter, the rotational direction of the cutter is changed from its rake-up to rake-down direction, and (f) shows a state in which the cutter is moved up and down repeatedly to perform vertical and reverse excavations.
Figure 2B:
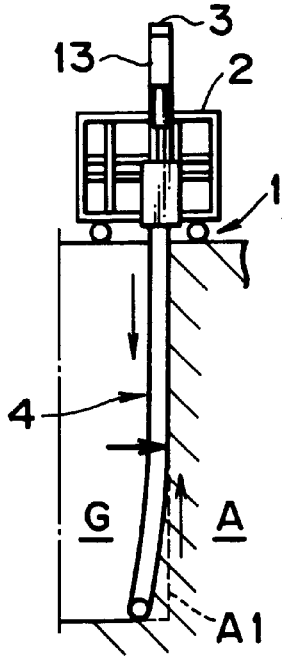
Figure 2C:
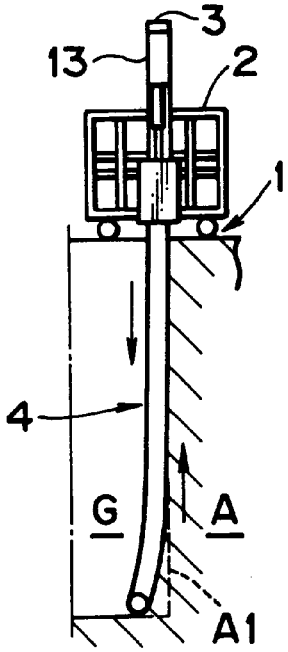
Figure 2D:
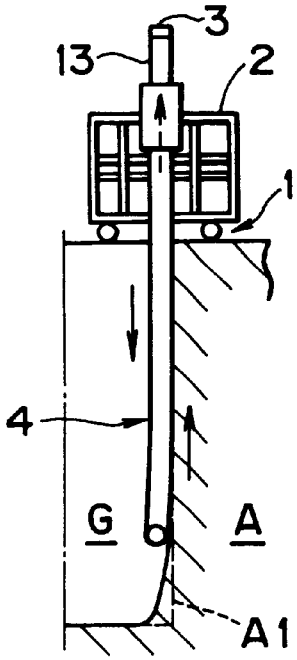
Figure 2E:
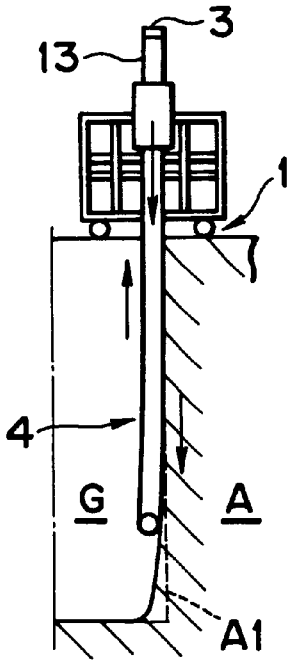
Figure 2F:
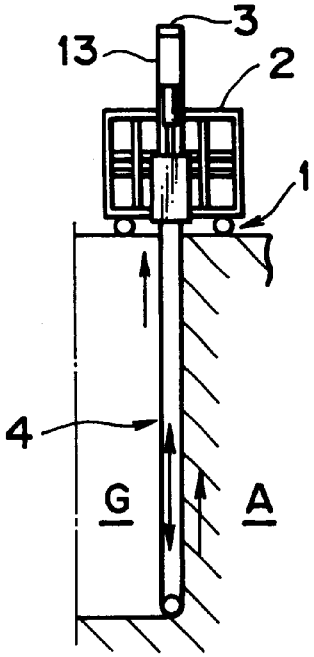

First Embodiment (see FIGS. 1 and 2)

FIG. 1 illustrates an entire construction of an excavating apparatus used in an excavating method according to the first embodiment of the invention. In the same figure, the same portions as in the conventional excavating apparatus of FIG. 6 are identified by the same reference numerals.

Figure 6:
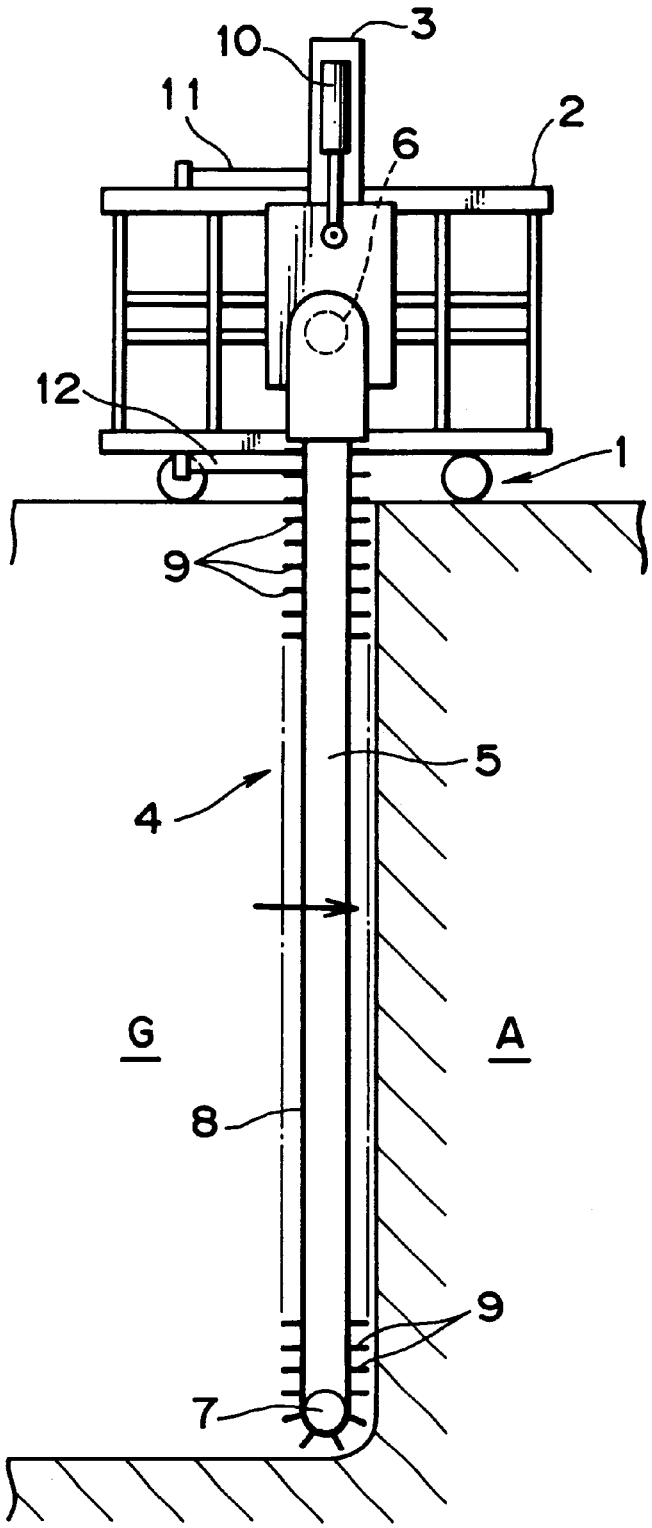
FIG. 6 is a front view schematically showing an entire construction of an excavating apparatus used in a conventional ditch excavating method.

The following description is now provided about only the difference from the apparatus shown in FIG. 6. In the excavating apparatus of this embodiment, a lift cylinder 13 for moving a cutter 4 vertically not only makes a depth adjustment in a small range as in the prior art but also functions to move the cutter 4 up and down at a large stroke for auxiliary excavation.

Therefore, as the lift cylinder 13 there is used a multi-stage cylinder (a two-stage cylinder in the illustrated example) so that there is obtained a larger stroke than the stroke of the lift cylinder 10 used in the conventional apparatus which cylinder makes only depth adjustment.

Further, to match the large stroke of the lift cylinder 13, there is used a leader 14 which is longer than the leader 3 used in the conventional apparatus.

The underground continuous ditch excavating method of this embodiment using the apparatus in question will be described below with reference to FIG. 2.

In FIG. 2 there is illustrated a schematic construction of the excavating apparatus, while the illustration of traversing cylinders and that of excavating edges of the cutter are omitted.

In the same figure, solid-line arrows represent rotating directions of the cutter 4. In normal excavation, the cutter rotates in the rake-up direction in which its excavating edges come into upward contact with the ground A, as shown in FIGS. (*a*) to (*d*).

FIG. 2(*a*)

There is illustrated a state of normal excavation performed by rake-up rotation of the cutter. At a predetermined depth, a ditch G is excavated while the cutter 4 is pushed against the ground A with a traversing force (indicated with a thick arrow in the figure) of traversing cylinders from the state of zero stroke of the traversing cylinders up to the state of maximum stroke.

At this time the cutter 4 is not deflected at all. As the excavation proceeds, the cutter tends to deflect.

FIG. 2(*b*)

The traversing cylinders reach their stroke end and the cutter 4 continues its rake-up rotation. With an increase of stress, the cutter begins to tilt or deflect forward in the excavating direction.

FIG. 2(*c*)

The cutter 4 has been returned to its original position by a switching operation for moving a traveling carrier car 1 forward while contracting the traversing cylinders.

The cutter 4 performs its rake-up rotation and remains tilted or deflected forward.

In this state, the excavation efficiency deteriorates to the extreme degree and a ground portion A1 left unexcavated arises at a lower portion of the ground A If this state continues, it will become impossible to excavate the ground portion A1.

FIG. 2(*d*)

To avoid such inconvenience, while the position shown in FIG. 2(*c*) is retained, the lift cylinder 13 is contracted and the cutter 4 raised. Consequently, the stress exerted on the cutter 4 decreases and the tilting or deflection of the cutter also diminishes or becomes extinct.

Regarding to what degree the cutter 4 is to be raised, it is determined appropriately in accordance with the stress exerted on the cutter 4 and the degree of tilting or deflection of the cutter 4.

FIG. 2(*e*)

After the cutter 4 has been raised, the rotating direction of the cutter 4 is reversed from the rake-up direction to the rake-down direction. Subsequently, a combined excavation of both vertical excavation and reverse excavation is started. As a result, the stress exerted on the cutter 4 and tilting or deflection thereof tend to become smaller.

On the other hand, a tangential resistance acting between the cutter 4 and the ground A becomes larger than in the previous traversing excavation.

FIG. 2(*f*)

After the cutter 4 has been brought down to the bottom of the ditch, the cutter 4 is again raised, and rake-down excavation is performed while the cutter 4 is subsequently brought down.

Thereafter, while the degree of vertical movement of the cutter is decreased gradually, the above vertical movements of the cutter are repeated by a required number of times.

By such a combined excavation of both vertical excavation performed with vertical movement of the cutter 4 and reverse excavation performed by reversing the rotating direction of the cutter, the stress exerted on the cutter 4 reverts gradually to the initial state and the tilting or deflection of the cutter also becomes extinct, so that the cutter 4 reverts to its original vertical state and the unexcavated portion A1 is excavated and removed.

Thereafter, a return is made to the normal traversing excavation in which the cutter 4 is allowed to perform the rake-up rotation while being pressed against the ground A by means of the traversing cylinders.

Thus, in accordance with the procedure illustrated in FIGS. 2(*a*) to (*f*) the excavating work is carried out by combining normal excavation with both vertical excavation and reverse excavation. As a result, there no longer is any lower ground portion left unexcavated and it becomes possible to effect a large-depth excavation which has been impossible in the prior art using only the traversing excavation.

According to excavation tests conducted for the same ground by the present inventor, an excavation depth limit is encountered at a distance of 25 m to 30 m in the case of the conventional excavation method using only the traversing excavation, while when the foregoing combined excavation of both vertical excavation and reverse excavation was performed at an appropriate timing, it was possible to effect excavation at a depth of 45.61 m.

Figure 3:
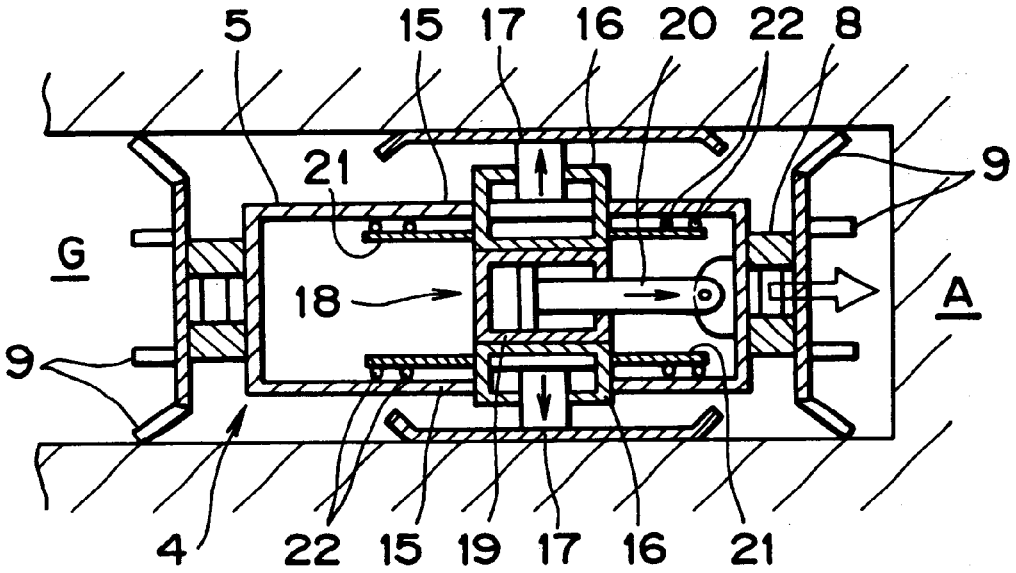
FIG. 3 is a horizontal sectional view of a lower portion of the cutter in an excavating apparatus used in a ditch excavating method according to the second embodiment of the present invention.
Figure 4:
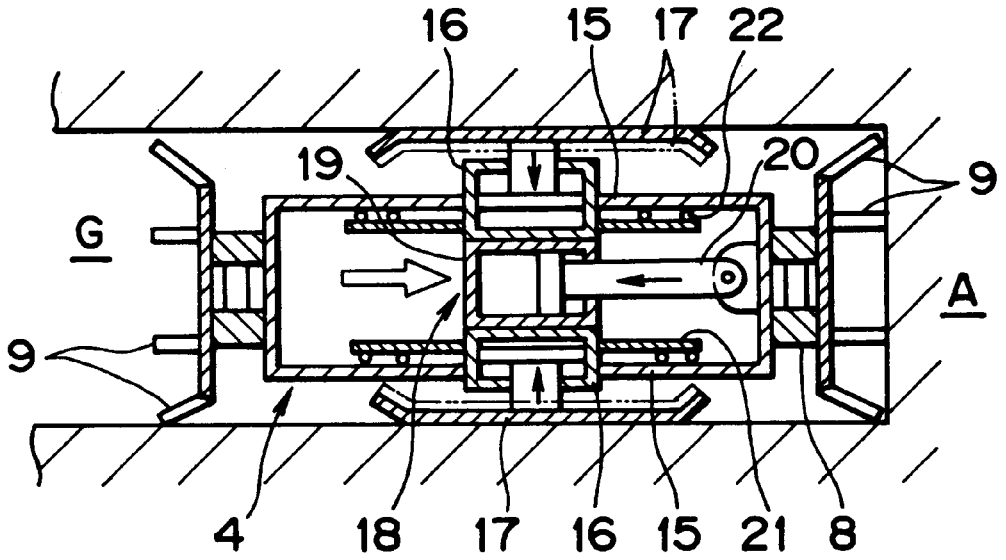
FIG. 4 is a horizontal sectional view in which, from the state of FIG. 3, the cutter has been pushed against the ground by the operation of an auxiliary propelling means.

Second Embodiment (see FIGS. 3 and 4)

In both vertical excavation and reverse excavation it is desirable that the cutter 4, especially the lower portion thereof, be pushed as strongly as possible against the ground A.

According to the second embodiment of the present invention, in view of the point just mentioned above, an auxiliary propelling means for making up the deficiency in traversing force of the lower portion of the cutter is provided at the lower portion of the cutter.

More specifically, such auxiliary propelling means is provided in a cutter post 5, and window holes 15, 15 are formed in right and left side walls of the cutter post 5, which right and left are for the excavating direction indicated with a doubleline arrow in FIG. 4 and are also true of the directionality to be referred to below, including front and rear directions. A pair of hydraulic jacks 16, 16 are disposed within the cutter post 5 respectively through the window holes 15, 15 so as to be movable in the front and rear direction along the window holes 15, 15.

Reaction force receiving members 17, 17, which are each in the form of a square plate, are attached perpendicularly to the end portions of the both-side hydraulic jacks 16, 16 projecting outward from the cutter post 5, to constitute a reaction force supporting mechanism. Upon expansion of the hydraulic jacks 16, 16, the surfaces of the reaction force receiving members 17, 17 come into contact with ditch wall surfaces, while upon contraction of the jacks the said surfaces move away from the ditch wall surfaces.

Within the cutter post 5, the both-side hydraulic jacks 16, 16 are connected to a cylinder tube 19 of a propelling cylinder 18 which is disposed horizontally in the front and rear direction. The tip of a piston rod 20 of the cylinder 18 is connected to the front inner wall of the cutter post 5.

Sealing plates 21, 21 are mounted respectively to the hydraulic jacks 16, 16 opposedly in proximity to the peripheral walls of the window holes 15, 15. On the inner surfaces of the peripheral walls of the window holes 15, 15 are disposed sealing members 22, . . . in contact with the sealing plates 21, 21. Sealing effect for the window hole portions is attained with these sealing plates and sealing members.

Further, though not shown, hydraulic pipes are disposed within the cutter post 5 for connecting the hydraulic jacks 16, 16 and propelling cylinder 18 to hydraulic pumps and tanks installed on the ground surface side.

The operation of this auxiliary propelling means will be described below.

FIG. 3 shows a state in which, during excavation, a gap is formed between the lower portion of the cutter post 13 and the ground A due to an insufficient propelling force fed from the ground surface side.

When the auxiliary propelling means is to be operated from this state, first the hydraulic jacks 16, 16 are extended to bring the reaction force receiving members 17, 17 into pressure contact with both right and left side walls of the excavated ditch G.

Next, with the propelling reaction force borne at the above pressed portions, the propelling cylinder 18 is extended, whereby the lower portion of the cutter post 5 (cutter 4) is allowed to move in the excavating direction and is pressed against the ground, as shown in FIG. 4.

In this way the deficiency in the propelling force applied to the lower portion of the cutter from the ground surface side is compensated by the auxiliary propelling means and the lower portion of the cutter is pressed against the ground A to carry out the excavating operation.

After excavating the ground in a predetermined amount, the hydraulic jacks 16, 16 are contracted, thereby allowing the reaction force receiving members 17, 17 to leave the wall surfaces of the ditch, as shown in phantom in FIG. 4, and in this state the propelling cylinder 18 is contracted.

By so doing, the both-side hydraulic jacks 16, 16 connected to the cylinder tube 19 of the propelling cylinder 18 move in the excavating direction as indicated with a doubleline arrow in FIG. 4 and revert to their original positions in FIG. 3 with respect to the cutter post 5.

By repeating such an extending/retracting motion it is possible to execute the auxiliary propelling operation continuously.

Therefore, when this auxiliary propelling operation is performed during normal excavation and also during both vertical excavation and reverse excavation, a propelling force acting in the excavating direction is applied to the lower portion of the cutter and hence it is possible to carry out the excavating work efficiently because:

(a) during normal excavation, tilting and deflection of the cutter 4 are prevented; and (b) even in the event tilting or deflection of the cutter 4 should occur, causing a ground portion A1 to be left unexcavated, the lower portion of the cutter can be pushed strongly against the unexcavated portion A1 to excavate the same portion.

It is optional whether the auxiliary propelling means is to be disposed at only the lower portion of the cutter or to be disposed at plural positions in the vertical direction of the cutter.

In the case of using a plurality of such auxiliary propelling means, they may be disposed so as to perform the same operation synchronously, but if they are disposed in a positionally deviated state longitudinally with respect to each other and are operated successively with time difference, it becomes possible to continue the pressing operation of the cutter lower portion against the ground without interruption.

As the reaction force bearing and propulsive actuators in the auxiliary propelling means there may be used air bags adapted to be increased and decreased in pressure to fulfill the reaction force bearing function and propelling function, in place of the hydraulic jacks 16 and hydraulic (propelling) cylinder 18.

Alternatively, there may be adopted a construction in which crawlers are provided at the tips of the both-side hydraulic jacks 16, 16 in the second embodiment, and the crawlers are rotated forward while being pressed against the ditch wall surfaces, whereby the lower portion of the cutter is moved forward continuously with the rotational force of the crawlers while the propulsive reaction force is borne by the contacted portions of the crawlers and the ditch wall surfaces.

Other Embodiments (1) In vertical excavation, for improving the bite of the cutter 4 to the ground A, it is considered most effective to let the cutter 4 perform its rake-down rotation while descending, as explained in the previous embodiments. This point has been demonstrated also by an experiment conducted by the present inventor.

However, even if vertical excavation is performed by bringing down the cutter 4 while keeping its rake-up rotation, there is attained a certain effect in removing the unexcavated ground portion A1 as compared with the case where vertical excavation is not performed.

(2) In reverse excavation, an outstanding effect is attained by moving the cutter 4 vertically. But even if the rotating direction of the cutter 4 is merely from rake-up to rake-down direction without vertical movement of the cutter 4, in FIG. 2(*c*), the bite of the cutter into the ground A is improved, so that there is attained a certain effect in excavating the unexcavated ground portion A as compared with the case where such change of rotating directions is not performed.

(3) As means for moving the cutter 4 vertically there may be adopted means which obtains the cutter descending force from only the own weight of the cutter, such as a winch or the like, instead of the lift cylinder 13 described in the previous embodiments.

However, it is desirable to use lift means capable of imparting a depressing force to the cutter, such as the lift cylinder 13 described in the previous embodiments. This is for the following reasons.

① In the excavating method wherein excavation is carried out while the cutter 4 is moved down, the application of a cutter depressing force separate from the own weight of the cutter affords a much higher excavation efficiency.

② Where there is adopted a construction method wherein a liquid solidifying material such as cement mill is poured into a ditch while excavation is allowed to proceed, it is necessary to impart to the cutter 4 a depressing force sufficient to overcome the buoyancy based on the solidifyig material and obtain a certain excavation effect.

(4) A certain construction method requires a columnar vertical hole to be formed midway of the excavated continuous ditch for installing a foundation pillar therein.

On the other hand, at each corner portion of the continuous ditch it is necessary to change the direction of the cutter 4 nearly perpendicularly.

In this case, it may be effective to mount the cutter 4 rotatably about a vertical axis and rotate it in the above portion where a columnar vertical hole is to be formed or in the corner portion.

However, since the size of the cutter 4 in the front and rear direction is larger than the ditch width, the load acting on the cutter 4 becomes too large and therefore it is actually very difficult for the cutter to rotate about the vertical axis in the above portion.

Figure 5:
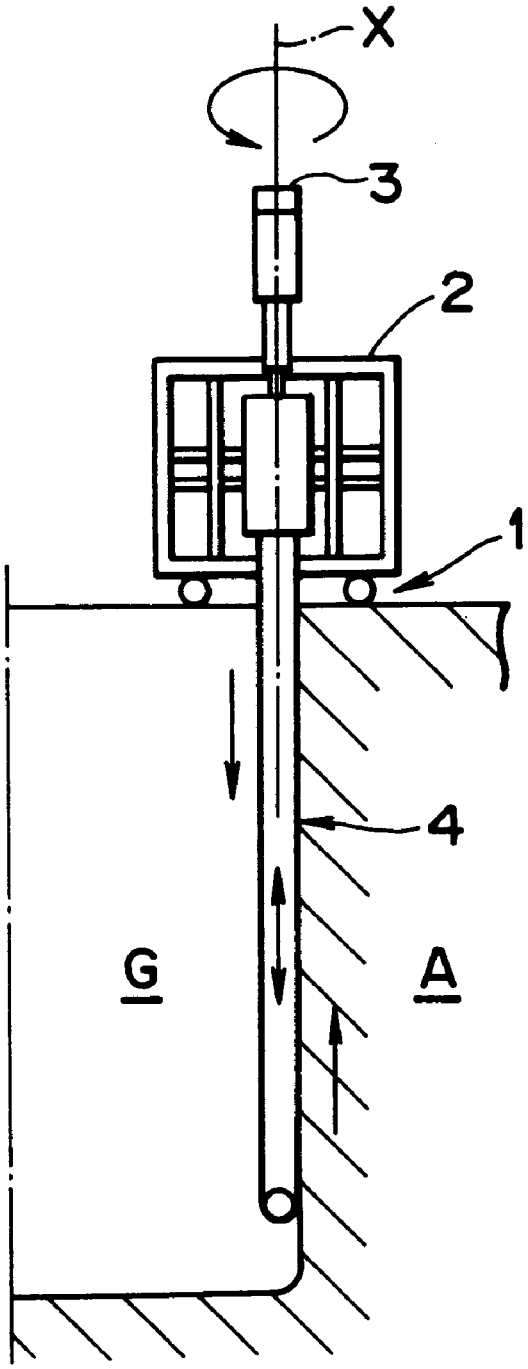
FIG. 5 is a schematic front view for explaining a method of rotating the cutter about a vertical axis according to a further embodiment of the present invention.

As shown in FIG. 5, by rotating the cutter 4 little by little about the vertical axis X while allowing it move upward or downward, it becomes possible to decrease the load acting on the cutter 4 and thereby rotate the cutter 4.

According to the present invention, as set forth hereinabove, in the case where a ground portion is likely to be left unexcavated at the lower portion of the cutter due to insufficiency of the traversing force or where there actually occurs a ground portion left unexcavated due to tilting or deflection of the cutter, there is adopted a vertical excavation in which the cutter is raised to decrease the stress acting on the lower portion of the cutter and is then brought down, allowing excavation to proceed, whereby the unexcavated portion can be excavated.

Further, by reversal of cutter rotating direction, the bite of the cutter into the ground A is improved and it is thereby possible to enhance the excavation efficiency to a higher extent than before the reversal of rotation.

Particularly, by changing from rake-up rotation to rake-down rotation during normal excavation, the bite of the excavating edges of the cutter into the ground portion A1 left unexcavated due to tilting or deflection of the cutter is improved and the unexcavated ground portion can be excavated thereby.

Moreover, by combining the two excavation methods, vertical excavation and reverse excavation, there is attained a synergistic effect of greatly improving the excavation efficiency in comparison with vertical excavation alone or reverse excavation alone, and it becomes possible to surely excavate the ground portion left unexcavated.

Further, in the case of adopting a construction method wherein a liquid solidifying material such as cement milk is poured into a ditch during excavation, it is possible to impart to the cutter a pressing force sufficient of overcome the buoyancy based on the solidifying material and thereby ensure the effect of excavation.

Therefore, by adopting the above excavation methods selectively as necessary, it becomes possible to excavate even a ground portion of a depth which cannot be excavated by traversing excavation alone, and hence possible to increase the limit depth in excavation.

What is claimed is:

1. A method of excavating an underground continuous ditch by rotating a chain cutter while pressing the cutter horizontally against the ground, with the cutter positioned underground, said chain cutter comprising a cutter post and an endless chain having excavating edges and stretched on said cutter post vertically, comprising the steps of:

vertical excavation involving excavating the ground while moving said chain cutter vertically downward while applying a depressing force to the chain cutter separately from the weight of the chain cutter; and vertical excavation involving excavating the ground while moving said cutter post of said chain cutter vertically upward.

2. The method of claim 1, wherein said vertical excavation is performed when said chain cutter has tilted or deflected forward with respect to an excavating direction.

3. The method of claim 1, wherein during said vertical excavation step a lower portion of said chain cutter is propelled horizontally using an auxiliary propelling means.

4. A method of excavating an underground continuous ditch by rotating a chain cutter while pressing the cutter horizontally against the ground, with the cutter positioned underground, said chain cutter comprising a cutter post and an endless chain having excavating edges and stretched on said cutter post vertically, comprising the simultaneous steps of:

a reverse excavation involving reversing a rotating direction of said chain cutter to reverse the operating direction of the excavating edge of the cutter against the ground, and a vertical excavation involving excavating the ground while moving said cutter post of said chain cutter vertically.

5. The method of claim 4, comprising the further step of rotating said chain type cutter in a rake-up direction in which the excavating edges of the cutter come into upward contact with the ground, while during the reverse excavation step the chain cutter is rotated in a rake-down direction in which the excavating edges of the cutter come into downward contact with the ground.

6. The method of claim 4, wherein said vertical excavation step and said reverse excavation step are performed simultaneously when said chain cutter has tilted or deflected forward with respect to an excavating direction.

7. The method of claim 4, wherein said vertical excavation step and said reverse excavation step are performed simultaneously while applying a depressing force to said chain cutter separately from the weight of the cutter.

8. The method of claim 6, wherein, when said vertical excavation step and said reverse excavation step are performed simultaneously, a lower portion of said chain cutter is propelled horizontally using an auxiliary propelling means.

9. A method of excavating an underground continuous ditch by rotating a chain cutter while pressing the cutter horizontally against the ground, with the cutter positioned underground, said chain cutter comprising a cutter post and an endless chain having excavating edges and stretched on said cutter post vertically, comprising the step of:

reverse excavation involving a reversing a rotating direction of said chain cutter to reverse the operating direction of the excavating edges of the cutter against the ground while excavating the underground continuous ditch horizontally with the cutter positioned underground.

10. The method of claim 9, comprising the further step of rotating said chain cutter in a rake-up direction in which the excavating edges of the cutter come into upward contact with the ground, while during the reverse excavation step the chain cutter is rotated in a rake-down direction in which the excavating edges of the cutter come into downward contact with the ground.

11. The method of claim 9, wherein said reverse excavation is performed when said chain cutter has tilted or deflected forward with respect to an excavating direction.

12. The method of claim 9, wherein said reverse excavation step is performed while applying a depressing force to said chain cutter separately from the weight of the cutter.

13. The method of claim 9, wherein during said reverse excavation step a lower portion of said chain cutter is propelled horizontally using an auxiliary propelling means.

14. A method of excavating an underground continuous ditch by rotating a chain cutter while pressing the cutter horizontally against the ground, with the cutter positioned underground, said chain cutter comprising a cutter post and an endless chain having excavating edges and stretched on said cutter post vertically, wherein the following steps are repeated:

excavating the ground while allowing said chain cutter to rotate in a rake-up direction;

moving said chain cutter upward;

moving said chain cutter downward while allowing the cutter to rotate in a rake-down direction; and repeating said upward movement of the chain cutter, and said downward movement of the cutter, while decreasing a degree of each said movement.

15. A method of excavating an underground continuous ditch by rotating a chain cutter while pressing the cutter horizontally against the ground, with the cutter positioned underground, said chain cutter comprising a cutter post and an endless chain having excavating edges and stretched on said cutter post vertically, wherein the following steps are repeated:

excavating the ground while allowing said chain cutter to rotate in a rake-up direction;

moving said cutter post of said chain cutter upward; and moving said chain cutter downward while allowing said chain cutter to rotate in a rake-down direction.

* * * * *

UNITED STATES PATENT AND TRADEMARK OFFICE

CERTIFICATE OF CORRECTION

PATENT NO. : 6,219,945 B1
DATED : April 24, 2001
INVENTOR(S) : Heishi et al.

It is certified that error appears in the above-identified patent and that said Letters Patent is hereby corrected as shown below:

Title page,
Insert the CPA information. It should read as follows:

-- [45] Date of Patent: *Apr. 24, 2001 --

-- [*] Notice: This patent issued on a continued prosecution application filed under 37 CFR 1.53(d), and is subject to the twenty year patent term provisions of 35 U.S.C. 154(a)(2). --

Signed and Sealed this

Twenty-fifth Day of December, 2001

*Attest:*

*Attesting Officer*

JAMES E. ROGAN
*Director of the United States Patent and Trademark Office*